US009272508B2

(12) United States Patent
Umeda et al.

(10) Patent No.: US 9,272,508 B2
(45) Date of Patent: Mar. 1, 2016

(54) ELEMENT SUBSTRATE, PRINTHEAD, AND PRINTING APPARATUS

(71) Applicant: CANON KABUSHIKI KAISHA, Tokyo (JP)

(72) Inventors: Kengo Umeda, Tokyo (JP); Nobuyuki Hirayama, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/457,175

(22) Filed: Aug. 12, 2014

(65) Prior Publication Data

US 2015/0062212 A1 Mar. 5, 2015

(30) Foreign Application Priority Data

Aug. 27, 2013 (JP) ..... 2013-176078

(51) Int. Cl.

| | |
|---|---|
| ***B41J 29/38*** | (2006.01) |
| ***B41J 2/155*** | (2006.01) |
| ***B41J 2/045*** | (2006.01) |
| ***B41J 2/16*** | (2006.01) |

(52) U.S. Cl.

CPC ..... *B41J 2/04543* (2013.01); *B41J 2/04541* (2013.01); *B41J 2/04573* (2013.01); *B41J 2/04585* (2013.01); *B41J 2/1601* (2013.01)

(58) Field of Classification Search

CPC ..... B41J 2/04573

See application file for complete search history.

(56) References Cited

U.S. PATENT DOCUMENTS

| | | | | |
|---|---|---|---|---|
| 4,540,996 | A * | 9/1985 | Saito | 347/43 |
| 5,629,771 | A * | 5/1997 | Mikami | 358/296 |
| 5,854,687 | A | 12/1998 | Mikami | |
| 6,890,048 | B2 | 5/2005 | Hirayama | |
| 7,044,572 | B2 | 5/2006 | Hirayama | |
| 7,600,839 | B2 | 10/2009 | Akama et al. | |
| 7,758,141 | B2 * | 7/2010 | Sakurai | B41J 2/04541 347/12 |
| 7,810,892 | B2 | 10/2010 | Yamaguchi et al. | |

(Continued)

FOREIGN PATENT DOCUMENTS

| | | | |
|---|---|---|---|
| CN | 1990243 | A | 7/2007 |
| CN | 101181841 | A | 5/2008 |

(Continued)

OTHER PUBLICATIONS

U.S. Appl. No. 14/286,098, filed May 23, 2014.

European Search Report corresponding to application No. 14002723.6 dated May 29, 2015—5 pages.

Chinese Office Action dated Sep. 6, 2015, in corresponding Chinese Patent Application No. 201410430939.1 (10 pages including English translation).

*Primary Examiner* — Shelby Fidler

(74) *Attorney, Agent, or Firm* — Fitzpatrick, Cella, Harper & Scinto

(57) ABSTRACT

An element substrate capable of suppressing occurrence of electromagnetic noise upon driving printing elements on an element substrate with long wiring lengths, preventing an operation error, and printing a high-quality image is provided. In the element substrate, plural element substrates each including printing elements are arrayed in an arrayed direction of the printing elements. Each element substrate including a wiring for supplying a driving power to drive the printing elements, and a ground wiring from the printing elements is configured as follows. Each element substrate includes a delay circuit for delaying a heat enable signal to drive the printing elements and supplying it to each printing element, and a switchover circuit for switching over, in accordance with a control signal, a delay sequence when supplying the heat enable signal to each printing element.

14 Claims, 17 Drawing Sheets

(56) References Cited

U.S. PATENT DOCUMENTS

| | | | | |
|---|---|---|---|---|
| 8,820,881 | B2 | 9/2014 | Wada | |
| 2001/0038396 | A1* | 11/2001 | Imanaka et al. | 347/7 |
| 2004/0179062 | A1* | 9/2004 | Rai et al. | 347/42 |
| 2005/0146547 | A1* | 7/2005 | Yeh et al. | 347/19 |
| 2007/0153036 | A1 | 7/2007 | Akama et al. | |
| 2008/0100649 | A1 | 5/2008 | Matsui et al. | |
| 2008/0111864 | A1 | 5/2008 | Yamaguchi et al. | |
| 2013/0027459 | A1 | 1/2013 | Wada | |

FOREIGN PATENT DOCUMENTS

| | | | |
|---|---|---|---|
| CN | 102896898 | A | 1/2013 |
| EP | 1 920 929 | A1 | 5/2008 |
| JP | 3323597 | B | 9/2002 |
| JP | 2008-114378 | A | 5/2008 |

* cited by examiner

PRINTED IMAGE

| Code | $b_n$ | ··· | $b_3$ | $b_2$ | $b_1$ | $b_0$ | A | B | C | D | E | F | G |
|---|---|---|---|---|---|---|---|---|---|---|---|---|---|
| 0 | 0 | ··· | 0 | 0 | 0 | 0 | HE7 | HE6 | HE5 | HE4 | HE3 | HE2 | HE1 |
| 1 | 0 | ··· | 0 | 0 | 0 | 0 | HE7 | HE6 | HE5 | HE4 | HE3 | HE1 | HE2 |
| 2 | 0 | ··· | 0 | 0 | 1 | 0 | HE7 | HE6 | HE5 | HE3 | HE4 | HE1 | HE2 |
| 3 | 0 | ··· | 0 | 0 | 1 | 1 | HE7 | HE5 | HE6 | HE3 | HE4 | HE1 | HE2 |
| 4 | 0 | ··· | 0 | 1 | 0 | 0 | HE6 | HE5 | HE7 | HE3 | HE4 | HE1 | HE2 |
| ⋮ | ⋮ | ⋮ | ⋮ | ⋮ | ⋮ | ⋮ | ⋮ | ⋮ | ⋮ | ⋮ | ⋮ | ⋮ | ⋮ |
| $2^n$ | 1 | ··· | 1 | 1 | 1 | 1 | HE1 | HE2 | HE3 | HE4 | HE5 | HE6 | HE7 |

PRINTED IMAGE

ELEMENT SUBSTRATE, PRINTHEAD, AND PRINTING APPARATUS

BACKGROUND OF THE INVENTION

1. Field of the Invention

The present invention relates to an element substrate, a printhead, and a printing apparatus and, particularly to, a full-line printhead that prints according to, for example, an inkjet method, and a printing apparatus that performs printing using the same.

2. Description of the Related Art

There is conventionally known an inkjet printhead that discharges ink from a plurality of orifices using thermal energy. To obtain stable discharge characteristics in this printhead, it is necessary to apply a stable voltage to heaters. A plurality of heater arrays are arranged on an element substrate for a printhead. When all heaters of one heater array are concurrently driven, large currents flow to ground wirings and driving power wirings that supply power to the heaters, and the voltage considerably drops due to the wiring resistance. To reduce the voltage drop, the number of heaters to be concurrently driven is limited in recent element substrates for a printhead. More specifically, the plurality of heaters are divided into a predetermined number of blocks and sequentially driven, that is, so-called time-divisional driving is performed, thereby implementing stable voltage application to the heaters.

When a plurality of heaters are concurrently driven, large currents flow to driving power wirings and ground wirings. At the leading and trailing edges of the large current supply, electromagnetic noise is generated by inductive coupling in the driving power wirings and the ground wirings.

The driving power wirings that apply a driving voltage to the heaters on the element substrate, the ground wirings, logic signal wirings that send signals to logic circuits on the element substrate, and the like are parallelly arranged on the printhead. Hence, the electromagnetic noise generated by the above-described inductive coupling may be superimposed on a logic signal and cause an operation error in a logic circuit provided on the element substrate. To prevent this, the element substrate that performs time-divisional driving executes control to delay the timing of a driving pulse to be applied to each heater in a selected block in nanoseconds. A current flowing in unit time is made small in this way, thereby suppressing occurrence of electromagnetic noise and preventing operation errors in the logic circuits on the element substrate (see Japanese Patent No. 3323597 and Japanese Patent Laid-Open No. 2008-114378).

To implement quicker printing, there has recently been proposed a full-line printhead that has a print width equal to or more than the width of a printing medium in advance by arranging a plurality of element substrates. The full-line printhead can perform high-speed printing because it is theoretically unnecessary to scan and move the printhead, and is used in a printing apparatus for business or industrial use.

Since the print width of the full-line printhead is long, the wiring length of a driving power wiring from the power supply circuit or capacitor to the element substrate and the wiring length of a ground wiring also become long. When the wiring lengths are long, the parasitic inductance components of the wirings are large. For this reason, when a large current flows, ringing occurs, and the driving voltage of the heaters largely varies. When the timing of a driving pulse to be applied to each heater in a selected block is delayed in a state in which the driving voltage of the heaters is ringing, a waveform difference occurs between the driving pulses to be applied to the heaters, and a difference between energies generated by the heaters is generated. This energy difference causes a difference between the amounts of ink discharged from the orifices, resulting in density unevenness in a printed image.

SUMMARY OF THE INVENTION

Accordingly, the present invention is conceived as a response to the above-described disadvantages of the conventional art.

For example, an element substrate, a printhead using the same, and a printing apparatus including the printhead according to this invention are capable of suppressing occurrence of electromagnetic noise upon driving printing elements on an element substrate with long wiring lengths, preventing an operation error, and printing a high-quality image.

According to one aspect of the present invention, there is provided an element substrate including a plurality of printing elements configured to generate energy to be used to discharge liquid, a wiring configured to supply a driving power to be used to drive the plurality of printing elements, a ground wiring from the plurality of printing elements, and a delay circuit configured to delay a heat enable signal to be used to drive the printing element and supply the heat enable signal to each of the plurality of printing elements. The element substrate comprises a switchover circuit configured to switch over, in accordance with a control signal, a delay sequence in a case where supplying the heat enable signal to each of the plurality of printing elements by the delay circuit.

According to another aspect of the present invention, there is provided a printhead using a plurality of element substrates having the above arrangement and supplying the driving power and the heat enable signals to the plurality of printing elements, thereby performing printing by the plurality of printing elements.

According to still another aspect of the present invention, there is provided a printhead comprising: a first element substrate, wherein a plurality of printing elements configured to generate energy to be used to discharge liquid, a wiring configured to supply a driving power to be used to drive the plurality of printing elements, and a ground wiring from the plurality of printing elements are integrated on the first element substrate; and a second element substrate, wherein a delay circuit configured to delay a heat enable signal to be used to drive the printing elements and supply the delayed heat enable signal to each of the plurality of printing elements is integrated on the second element substrate. In the printhead, the delay circuit includes a switchover circuit configured to switch over, in accordance with a control signal, a delay sequence upon supplying the heat enable signal to each of the plurality of printing elements by the delay circuit, and printing is performed by the plurality of printing elements by supplying the driving power and the delayed heat enable signal to the plurality of printing elements.

According to still another aspect of the present invention, there is provided a printing apparatus using a printhead having the above-described arrangement, particularly, for example, a full-line inkjet printhead that has a print width corresponding to the width of a printing medium and performs printing by discharging ink according to an inkjet method.

The invention is particularly advantageous since it is possible to suppress occurrence of electromagnetic noise due to rising and falling of a current supplied at the time of driving of the printing elements, prevent an operation error of a circuit, and achieve high-quality image printing.

Further features of the present invention will become apparent from the following description of exemplary embodiments (with reference to the attached drawings).

DESCRIPTION OF THE EMBODIMENTS

Figure 1:
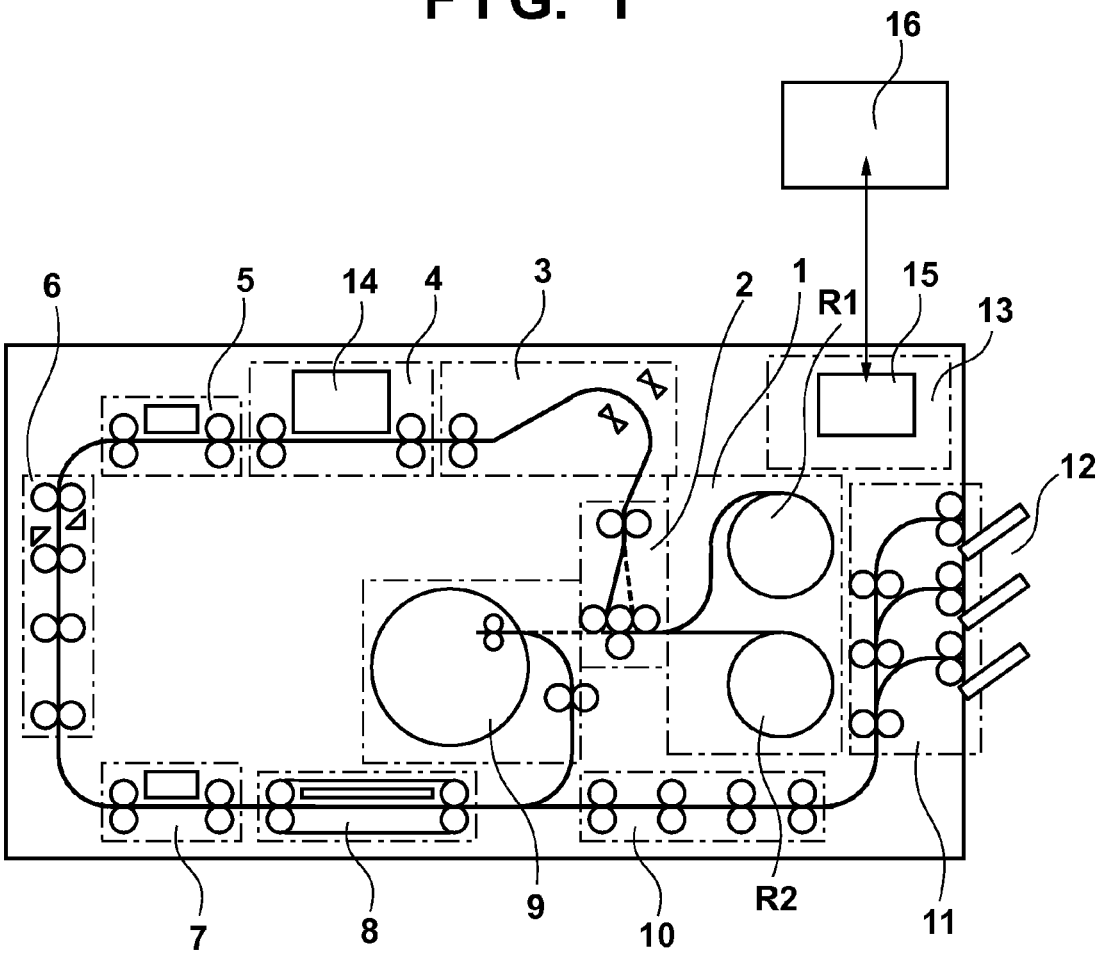
FIG. 1 is a schematic side sectional view showing the internal arrangement of an inkjet printing apparatus according to an exemplary embodiment of the present invention.

Exemplary embodiments of the present invention will now be described in detail in accordance with the accompanying drawings. Note that the same reference numerals denote already explained parts, and a repetitive description thereof will be omitted.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "nozzle" generically means an ink orifice or a liquid channel communicating with it, and an element for generating energy used to discharge ink, unless otherwise specified.

An element substrate (head substrate) for a printhead to be used below indicates not a mere base made of silicon semiconductor but a component provided with elements, wirings, and the like.

"On the substrate" not only simply indicates above the element substrate but also indicates the surface of the element substrate and the inner side of the element substrate near the surface. In the present invention, "built-in" is a term not indicating simply arranging separate elements on the substrate surface as separate members but indicating integrally forming and manufacturing the respective elements on the element substrate in, for example, a semiconductor circuit manufacturing process.

An embodiment of an inkjet printing apparatus will be described next. This printing apparatus is a high-speed line printer that uses a continuous sheet (print medium) wound into a roll and supports both single-sided printing and double-sided printing. The printing apparatus is suitable for, for example, a mass print field in a print laboratory or the like.

<Inkjet Printing Apparatus (FIGS. 1 to 3)>

FIG. 1 is a side sectional view showing the schematic internal arrangement of an inkjet printing apparatus (to be referred to as a printing apparatus hereinafter) according to an exemplary embodiment of the present invention. The interior of the apparatus can roughly be divided into a sheet supply unit 1, a decurling unit 2, a skew adjustment unit 3, a print unit 4, a cleaning unit (not shown), an inspection unit 5, a cutter unit 6, an information printing unit 7, a drying unit 8, a sheet winding unit 9, a discharge conveyance unit 10, a sorter unit 11, a discharge tray 12, a control unit 13, and the like. A sheet is conveyed by a conveyance mechanism including roller pairs and a belt along a sheet conveyance path indicated by the solid line in FIG. 1 and undergoes processing of each unit.

The sheet supply unit 1 stores and supplies a continuous sheet wound into a roll. The sheet supply unit 1 can store two rolls R1 and R2, and is configured to selectively draw and supply a sheet. Note that the number of storable rolls is not limited to two, and one or three or more rolls may be stored. The decurling unit 2 reduces the curl (warp) of the sheet supplied from the sheet supply unit 1. The decurling unit 2 bends and strokes the sheet so as to give a warp in an opposite direction to the curl using two pinch rollers with respect to one driving roller, thereby reducing the curl. The skew adjustment unit 3 adjusts the skew (tilt with respect to the original traveling direction) of the sheet that has passed through the decurling unit 2. A sheet end on a reference side is pressed against a guide member, thereby adjusting the skew of the sheet.

The print unit 4 forms an image on the conveyed sheet by a printhead unit 14. The print unit 4 also includes a plurality of conveyance rollers configured to convey the sheet. The printhead unit 14 includes a full-line printhead (inkjet printhead) in which an inkjet nozzle array is formed within a range covering the maximum width of sheets assumed to be used. In the printhead unit 14, a plurality of printheads are arranged parallelly along the sheet conveyance direction. In this embodiment, the printhead unit 14 includes four printheads corresponding to four colors of K (black), C (cyan), M (magenta), and Y (yellow). The printheads are arranged in the order of K, C, M, and Y from the upstream side of sheet conveyance. Note that the number of ink colors and the number of printheads are not limited to four. As the inkjet method, a method using heating elements, a method using piezoelectric elements, a method using electrostatic elements, a method using MEMS elements, or the like can be employed. The respective color inks are supplied from ink tanks to the printhead unit 14 via ink tubes.

The inspection unit 5 optically reads an inspection pattern or image printed on the sheet by the print unit 4, and inspects the states of nozzles of the printheads, the sheet conveyance state, the image position, and the like. The inspection unit 5 includes a scanner unit that actually reads an image and generates image data, and an image analysis unit that analyzes the read image and returns the analysis result to the print unit 4. The inspection unit 5 includes a CCD line sensor which is arranged in a direction perpendicular to the sheet conveyance direction.

Figure 2:
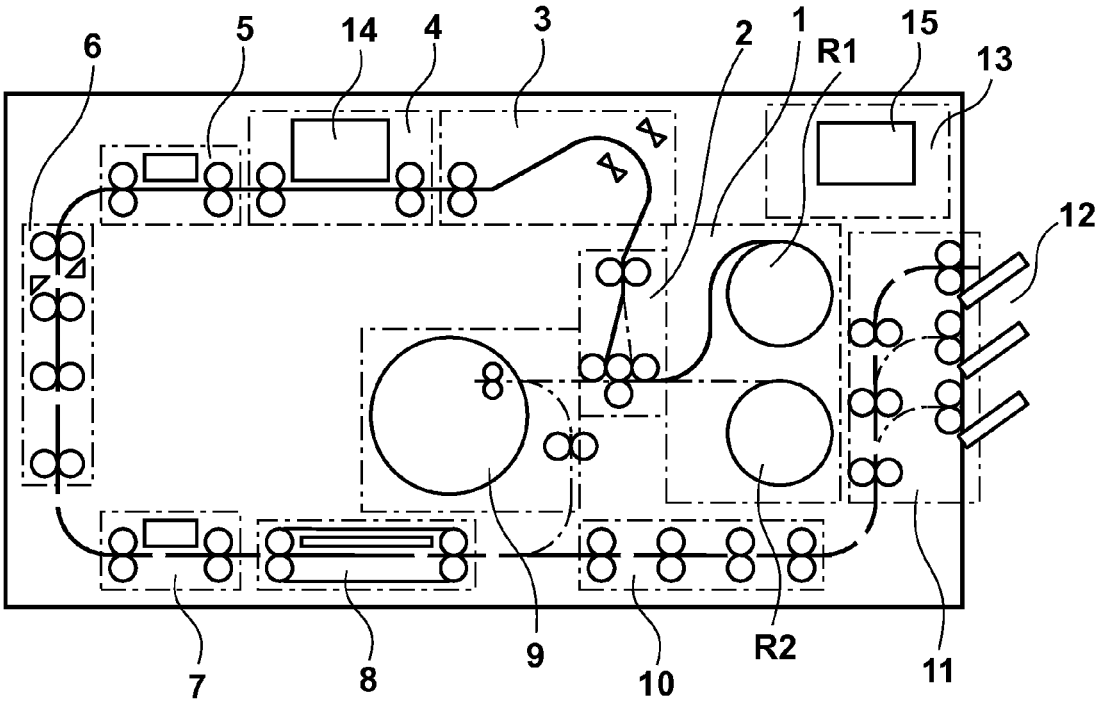
FIG. 2 is a view for explaining the single-sided printing operation of the printing apparatus shown in FIG. 1.
Figure 3:
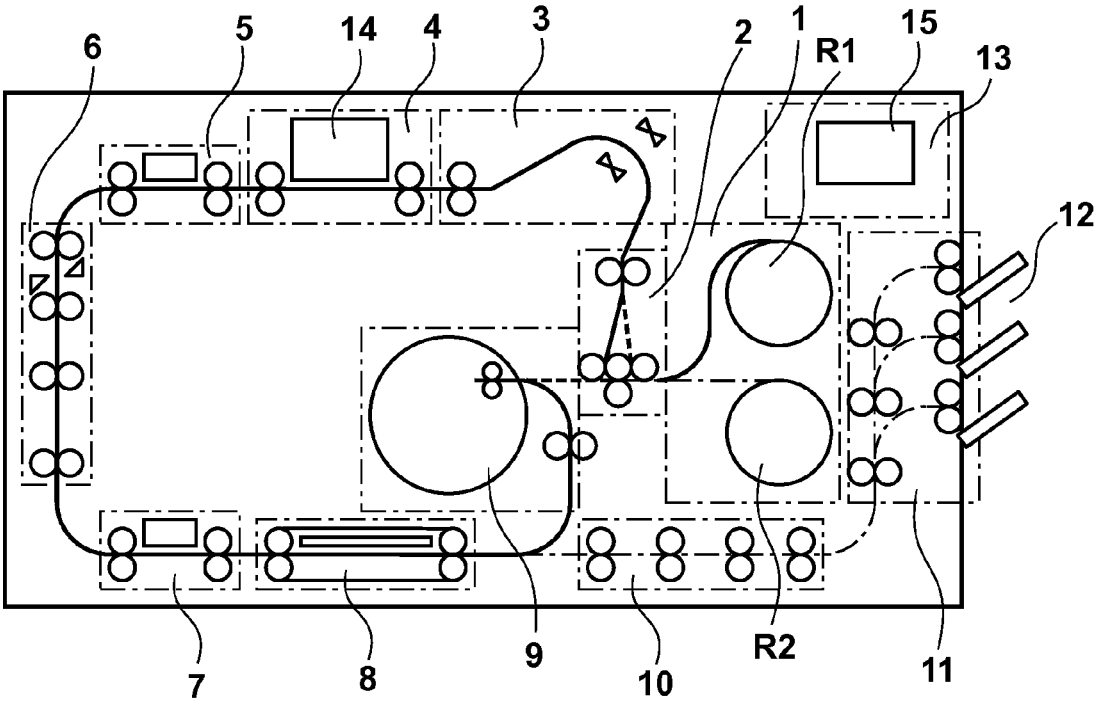
FIG. 3 is a view for explaining the double-sided printing operation of the printing apparatus shown in FIG. 1.

Note that the printing apparatus shown in FIG. 1 supports both single-sided printing and double-sided printing, as described above. FIGS. 2 and 3 are views for explaining the single-sided printing operation and double-sided printing operation of the printing apparatus shown in FIG. 1, respectively.

<Full-Line Printhead (FIGS. 4 to 6)>

Figure 4:
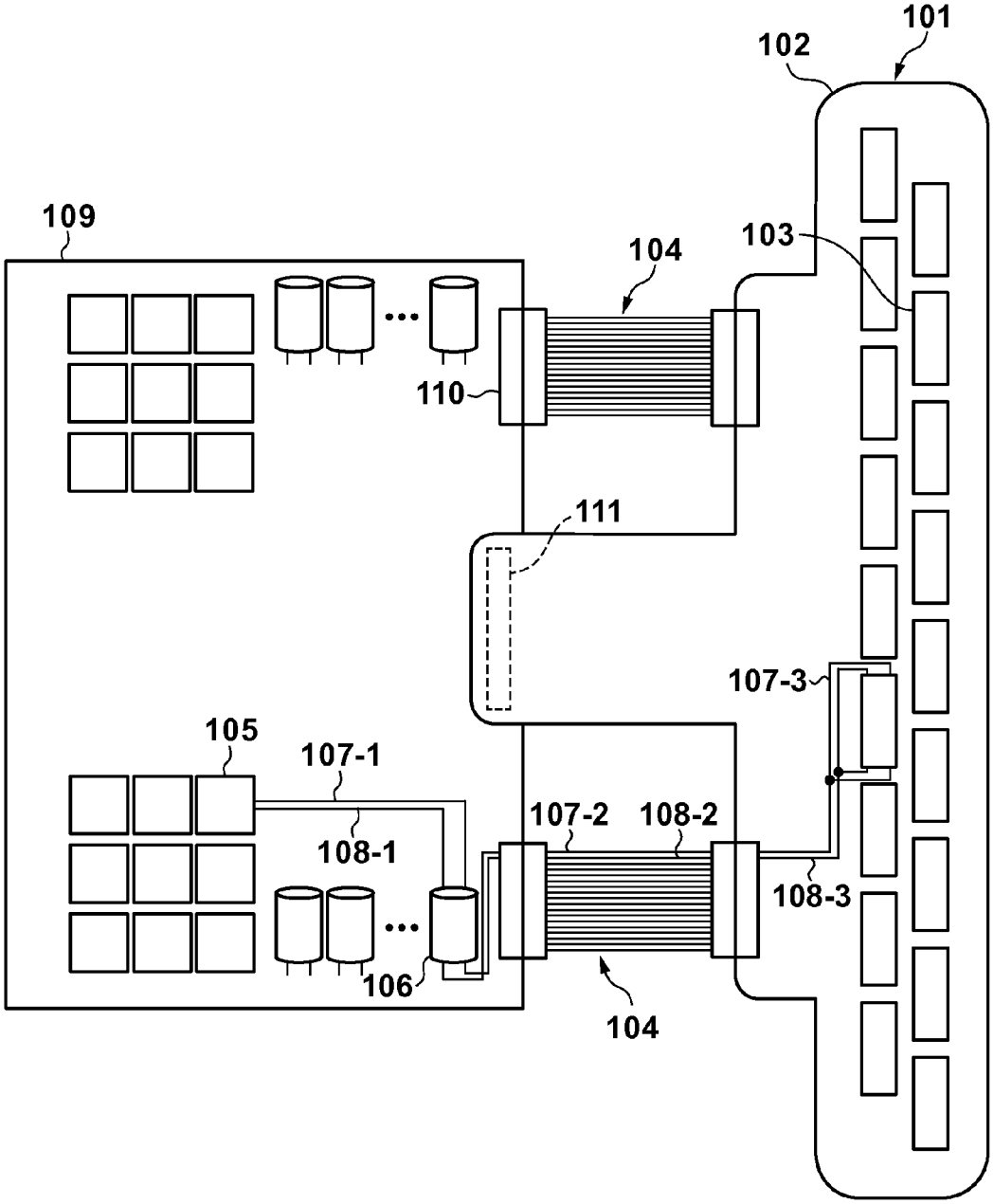
FIG. 4 is a view showing the schematic arrangement of a full-line printhead.

FIG. 4 is a view showing the schematic arrangement of a full-line printhead.

As shown in FIG. 4, a plurality of element substrates 103 are arranged zigzag on a printed board 102 in an element substrate 101 of a full-line printhead and electrically connected to a head control substrate 109 via first connectors 110, cables 104, and a second connector 111. A plurality of printing elements each of which generates energy to be used to discharge liquid such as ink are integrated on each element substrate 103. The plurality of element substrates are arranged in the arrayed direction of the printing elements, thereby attaining a print width corresponding to a width of a printing medium. A driving voltage VH to be used to drive the printing elements in each element substrate 103 and a ground GNDH are generated by a power supply circuit 105 of the head control substrate 109. These voltages are supplied to each element substrate 103 via driving power wirings 107-1, 107-2, and 107-3 and ground wirings 108-1, 108-2, and 108-3.

To stabilize the driving voltage VH, capacitors 106 are integrated on the head control substrate 109. Since the capacitor is a component having certain thickness, a space in the height direction is necessary to integrate it on the substrate. To cause an ink droplet discharged from the element substrate 103 to accurately land on a printing medium, the distance between the printing medium and the element substrate 103 needs to be about 1 mm. It is therefore difficult to ensure the space in the height direction to integrate the capacitors 106 on the printed board 102, and the capacitors 106 are integrated on the head control substrate 109.

The driving power wiring is divided into the driving power wiring 107-1 on the head control substrate 109, the driving power wiring 107-2 of the cable 104, and the driving power wiring 107-3 on the printed board 102, as shown in FIG. 4. When collectively referring to these, they will simply be referred to as the driving power wirings 107. Similarly, the ground wiring 108 is divided into the ground wiring 108-1 on the head control substrate 109, the ground wiring 108-2 of the cable 104, and the ground wiring 108-3 on the printed board 102. When collectively referring to these, they will simply be referred to as the ground wirings 108.

Figure 5:
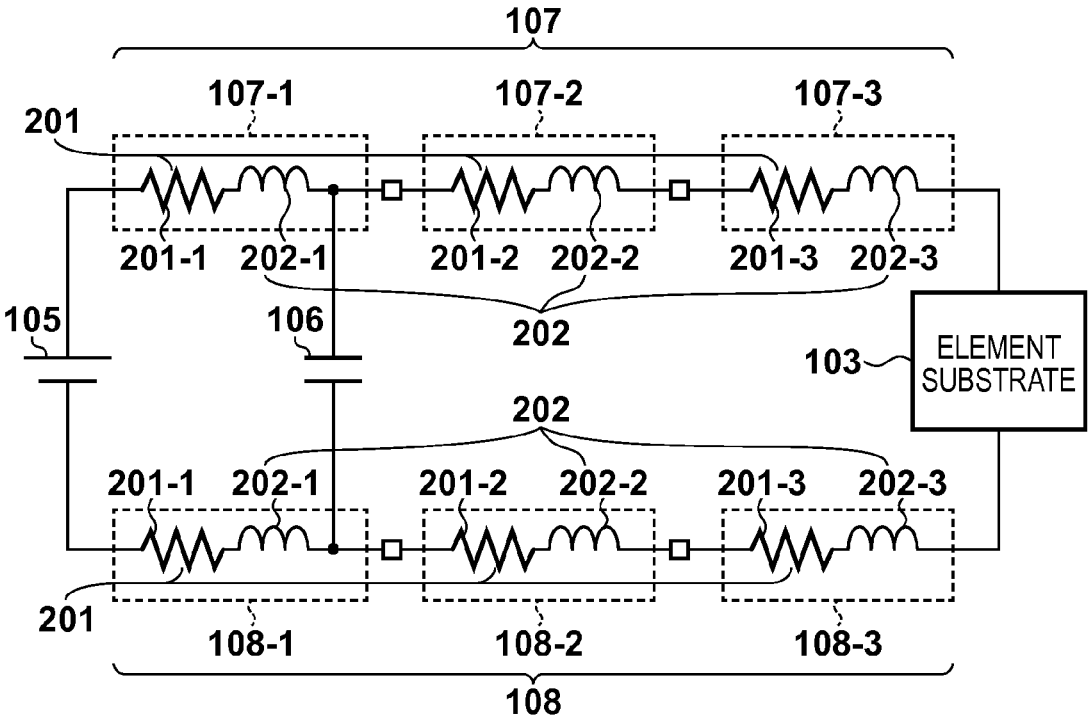
FIG. 5 is a view showing the equivalent circuits of driving power wirings and ground wirings.

FIG. 5 is a view showing the equivalent circuits of the driving power wirings 107 and the ground wirings 108.

Each of the driving power wirings 107-1, 107-2, and 107-3 and the ground wirings 108-1, 108-2, and 108-3 has a parasitic inductance 202. In FIG. 5, the parasitic inductances 202 are divisionally illustrated as parasitic inductances 202-1, 202-2, and 202-3 of the portions of the head control substrate 109, the cable 104, and the printed board 102, respectively. Also, each of the driving power wirings 107-1, 107-2, and 107-3 and the ground wirings 108-1, 108-2, and 108-3 has a wiring resistance 201. In FIG. 5, the wiring resistances 201 are divisionally illustrated as wiring resistances 201-1, 201-2, and 201-3 of the portions of the head control substrate 109, the cable 104, and the printed board 102, respectively.

The value of the parasitic inductance 202 increases in proportion to the wiring length of the driving power wiring or the ground wiring. Since the full-line printhead has a print width equal to or more than the width of a printing medium, each of the driving power wiring 107-3 and the ground wiring 108-3 on the printed board 102 may have a wiring length of 100 mm or more. In addition, because of restrictions of the arrangement of the head control substrate 109 and the element substrate 101 of the full-line printhead in the printing apparatus, each of the driving power wiring 107-2 and the ground wiring 108-2 of the cable 104 may also have a wiring length of 200 mm or more. For these reasons, the wiring length of the driving power wiring from the capacitor 106 to the element substrate 103 may be 300 mm or more, and the parasitic inductance value becomes large. More specifically, the parasitic inductances 202-2 and 202-3 from the capacitor 106 have a value of the order of several hundred nH in all. When a large current flows to the parasitic inductance of several hundred nH, ringing occurs.

Figure 6:
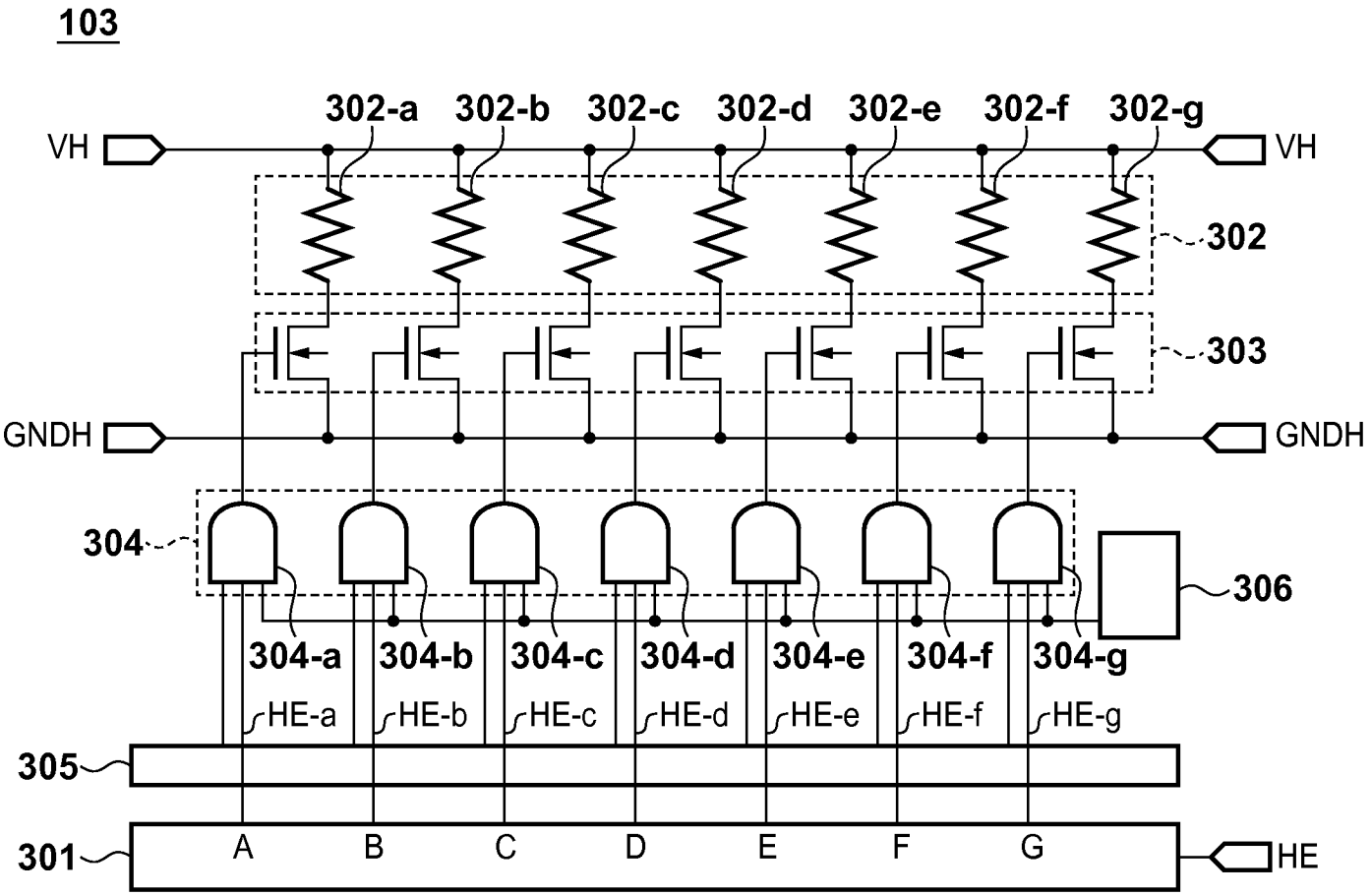
FIG. 6 is a circuit diagram showing part of an element substrate, particularly, heaters serving as printing elements and a driving circuit thereof.

FIG. 6 is a circuit diagram showing part of the element substrate 103, particularly, heaters serving as printing elements and a driving circuit thereof.

Referring to FIG. 6, a delay circuit 301 delays enable signals. A heater group 302 serves as printing elements configured to heat and discharge ink. A transistor group 303 drives the heater group 302. A control gate group 304 controls the transistor group 303. A latch circuit 305 latches data to be sent to the transistor group 303 via the control gate group 304. A block selection logic circuit 306 activates the control gates of the control gate group 304 on a time-divisional block basis.

Note that when individually referring to the heaters of the heater group 302, they will be referred to with suffixes as heaters 302-*a* to 302-*g*. Similarly, when individually referring to the control gates of the control gate group 304, they will be referred to with suffixes as control gates 304-*a* to 304-*g*.

The block selection logic circuit 306 is formed from a decoder or the like and configured to sequentially designate a plurality of blocks. For the descriptive simplicity, this circuit is assumed to be configured to decode a block selection signal and then select one block by the decoded block selection signal.

A heat enable signal HE enables a specific control gate of the control gate group 304 for a predetermined period. The heat enable signal HE is input from outside of the element substrate 103 or generated by an HE generation circuit (not shown) in the element substrate 103. Reference symbols HE-a to HE-g denote signals obtained by delaying the signal HE by the delay circuit 301; VH, an electrode pad that bundles the driving power wirings configured to apply a driving voltage to the heater group 302; and GNDH, an electrode pad that bundles the ground wirings of the heater group 302.

Several embodiments of the delay circuit integrated on the element substrate will be described next using the inkjet printing apparatus and the full-line printhead having the above-described arrangement as a common embodiment.

First Embodiment

Figure 7A:
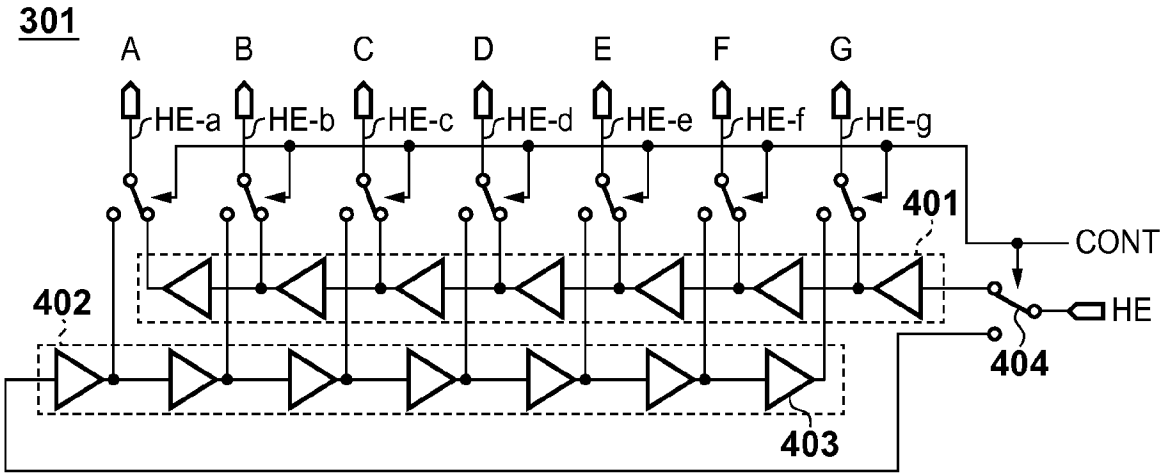
FIGS. 7A and 7B are circuit diagrams showing the arrangement of a delay circuit according to the first embodiment of the present invention.
Figure 7B:
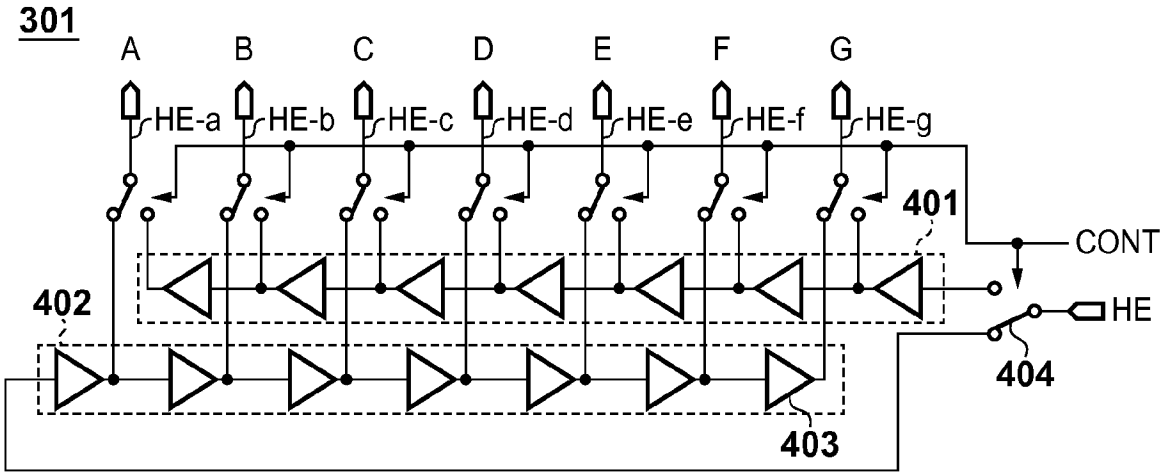

FIGS. 7A and 7B are circuit diagrams showing the arrangement of a delay circuit 301 according to the first embodiment of the present invention.

Referring to FIGS. 7A and 7B, terminals A to G and HE correspond to the terminals A to G and HE of the delay circuit 301 shown in FIG. 6. The delay circuit 301 is formed from a first delay buffer group 401, and a second delay buffer group 402 having a delay sequence different from that of the first delay buffer group 401. A buffer circuit 403 is formed from, for example, two stages of inverter circuits. A switchover circuit 404 is formed from a switch of a MOS transistor. The switchover circuit 404 has a function of switching over a delay signal to be output to the terminals A to G every predetermined time in accordance with a delay sequence control signal CONT.

FIG. 7A is a view showing the connection state when the logic level of the delay sequence control signal CONT is low. Delay signals generated by the first delay buffer group 401 are output to the terminals A to G. Hence, a signal HE-a is the most delayed signal. On the other hand, FIG. 7B is a view showing the connection state when the logic level of the delay sequence control signal CONT is high. Delay signals generated by the second delay buffer group 402 are output to the terminals A to G. Hence, a signal HE-g is the most delayed signal.

The detailed operation of an element substrate 103 will be described below with reference to FIG. 6 based on the operation of the delay circuit 301 as described above.

According to FIG. 6, all heaters of a heater group 302 selected by a block selection logic circuit 306 are driven. When the delay sequence control signal CONT is at low level, first, the signal HE-g is input to a control gate 304-*g*, a driving pulse signal is input to a heater 302-*g*, and a current starts flowing.

Next, a signal HE-f obtained by causing the delay circuit 301 to delay the signal HE-g by a predetermined time is input to a control gate 304-*f*, a driving pulse signal delayed by a predetermined time is input to a heater 302-*f*, and a current starts flowing. Next, a signal HE-e obtained by causing the delay circuit 301 to delay the signal HE-f by a predetermined time is input to a control gate 304-*e*, a driving pulse signal delayed by a predetermined time is input to a heater 302-*e*, and a current starts flowing. This operation is repeated to drive the heaters 302-*g*, 302-*f*, 302-*e*, 302-*d*, 302-*c*, 302-*b*, and 302-*a* in this order.

On the other hand, when the delay sequence control signal CONT is at high level, first, the signal HE-a is input to a control gate 304-*a*, a driving pulse signal is input to the heater 302-*a*, and a current starts flowing. Next, a signal HE-b obtained by causing the delay circuit 301 to delay the signal HE-a by a predetermined time is input to a control gate 304-*b*, a driving pulse signal delayed by a predetermined time is input to the heater 302-*b*, and a current starts flowing. Next, a signal HE-c obtained by causing the delay circuit 301 to delay the signal HE-b by a predetermined time is input to a control gate 304-*c*, a driving pulse signal delayed by a predetermined time is input to the heater 302-*c*, and a current starts flowing. This operation is repeated to drive the heaters 302-*a*, 302-*b*, 302-*c*, 302-*d*, 302-*e*, 302-*f*, and 302-*g* in this order.

Figure 8A:
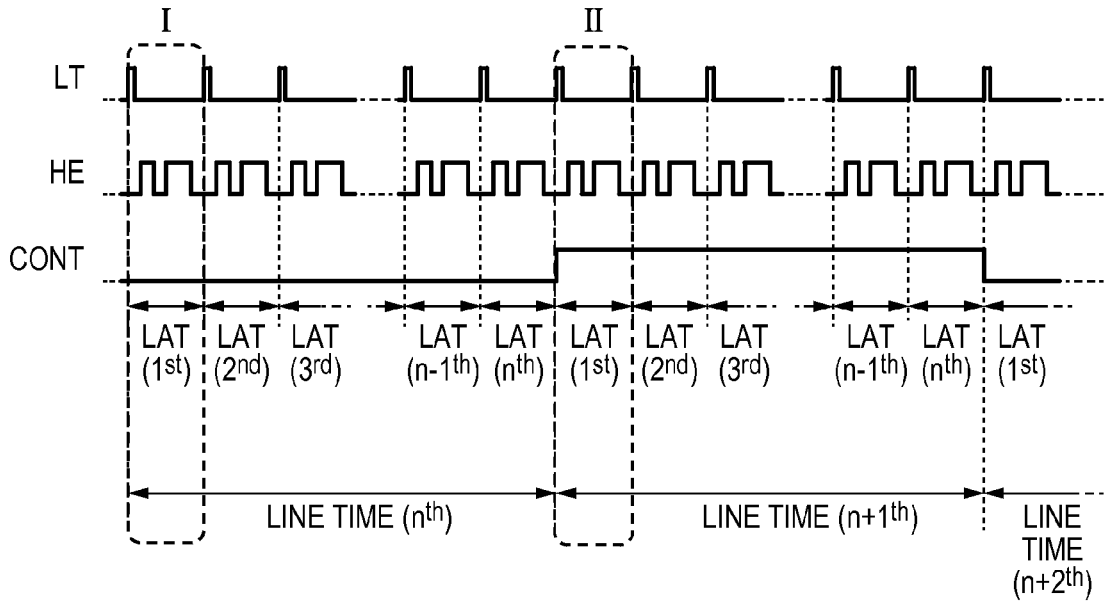
FIGS. 8A, 8B, and 8C are driving timing charts of printing elements.
Figure 8B:
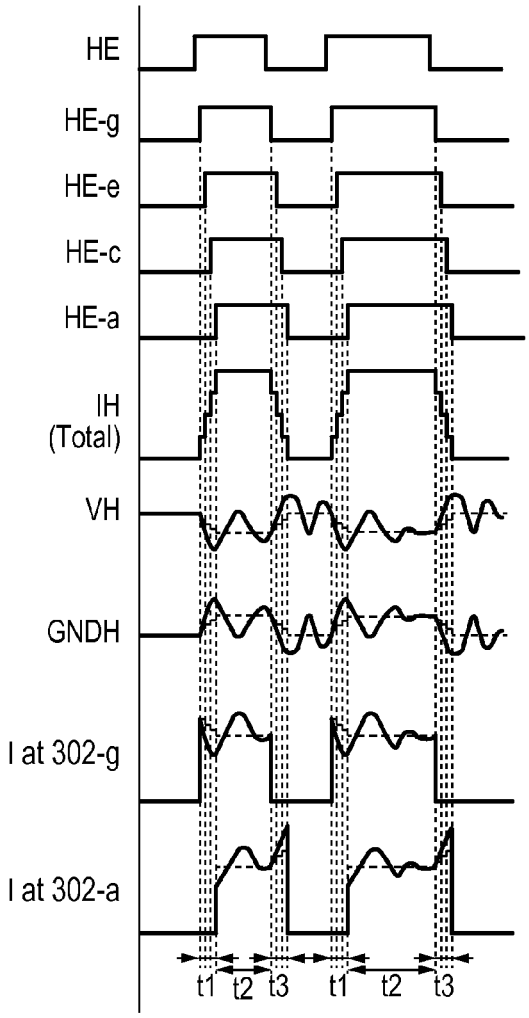
Figure 8C:
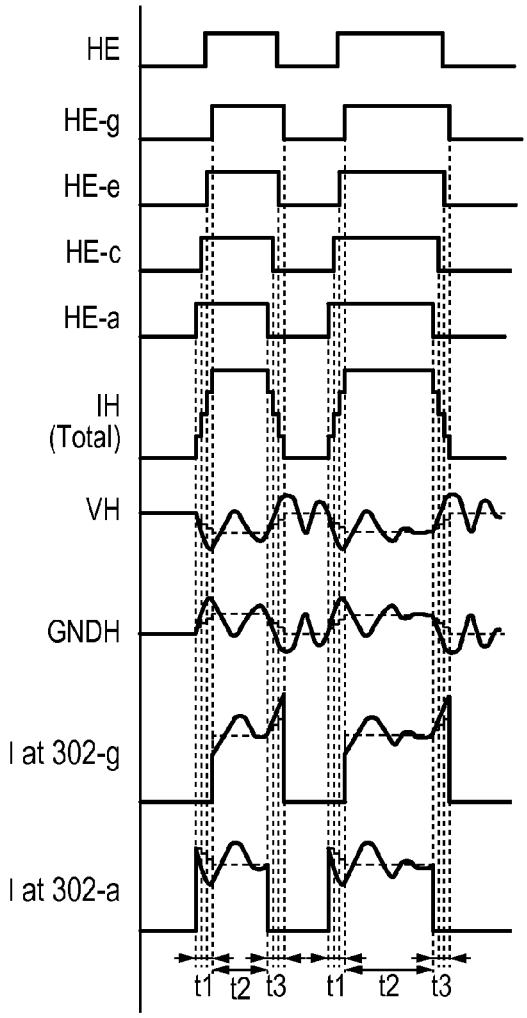

FIGS. 8A to 8C are driving timing charts of the printing elements.

FIG. 8A is a chart showing the timings of a latch signal LT, the enable signal HE, and the delay sequence control signal CONT. Referring to FIG. 8A, a line time indicates a time to print an image corresponding to one column or one row on a printing medium. The element substrate performs time-divisional driving of dividing printing of one line into a predetermined number of blocks and sequentially driving the heaters. A latch time LAT is a time per block. The latch signal LT is a signal used to identify one block. This element substrate switches over the delay sequence direction every line time.

FIG. 8B is the detailed timing chart of a portion I in FIG. 8A, that is, the timing chart when the logic level of the delay sequence control signal CONT is low. On the other hand, FIG. 8C is the detailed timing chart of a portion II in FIG. 8A, that is, the timing chart when the logic level of the delay sequence control signal CONT is high.

Referring to FIGS. 8B and 8C, VH represents the voltage waveform of VH; GNDH, the voltage waveform of GNDH; and IH, the current waveform of a current that flows to VH.

During a period t1, the heaters sequentially start driving, and the value of the current IH gradually increases (rise of IH). At the rise time, the current IH flows to parasitic inductances 202 interspersed in driving power wirings 107. This results in ringing in VH and GNDH. More specifically, undershoot ringing occurs in the voltage waveform of VH, and overshoot ringing occurs in the voltage waveform of GNDH. For this reason, the voltage applied across the heater 302 during the period t1 is lower than that during a period t2, and the current that flows to the heaters 302 also becomes small.

During a period t3, the heaters sequentially end driving, and the value of the current IH gradually decreases (fall of IH). At the fall time, the current IH flows to the parasitic inductances 202. This results in ringing in VH and GNDH, again. More specifically, overshoot ringing occurs in the voltage waveform of VH, and undershoot ringing occurs in the voltage waveform of GNDH. For this reason, the voltage applied across the heater 302 during the period t3 is higher than that during the period t2, and the current that flows to the heaters 302 becomes large.

Hence, energy generated by the heater selected first is the smallest. Generated energy gradually becomes large as the timing of selection of a heater becomes later. Energy generated by the heater selected last is the largest. This energy difference causes a difference between the amounts of ink discharged from the orifices of the full-line printhead. For example, when the delay sequence control signal CONT is at low level, the heater selected first is the heater 302-*g*, and the heater selected last is the heater 302-*a*. FIG. 8B shows a current change (I at 302-*g*) in the heater 302-*g* and a current change (I at 302-*a*) in the heater 302-*a*. The energy generated by the heater 302-*g* is smaller by about 11% than the energy generated by the heater 302-*a*. Because of the energy difference, the amount of ink discharged from an orifice corresponding to the heater 302-*g* is smaller by about 3% than the amount of ink discharged from an orifice corresponding to the heater 302-*a*.

On the other hand, when the delay sequence control signal CONT is at high level, the heater selected first is the heater 302-*a*, and the heater selected last is the heater 302-*g*. FIG. 8C shows a current change (I at 302-*g*) in the heater 302-*g* and a current change (I at 302-*a*) in the heater 302-*a*. The energy generated by the heater 302-*g* is larger by about 11% than the energy generated by the heater 302-*a*. Because of the energy difference, the amount of ink discharged from an orifice corresponding to the heater 302-*g* is larger by about 3% than the amount of ink discharged from an orifice corresponding to the heater 302-*a*.

Figure 9A:
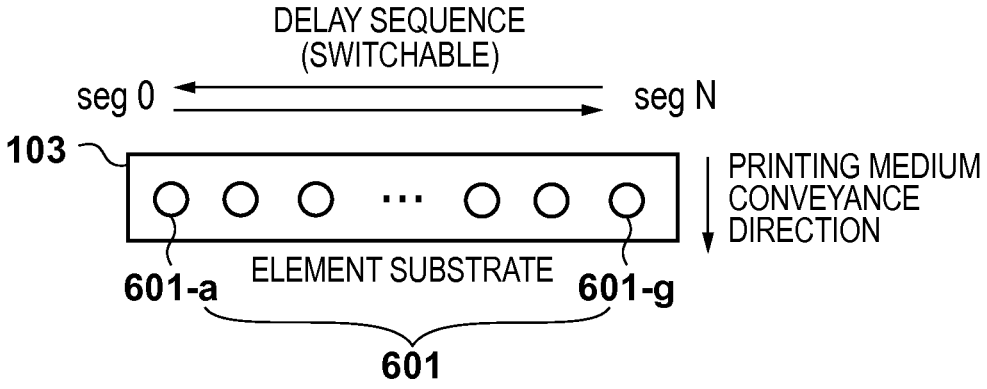
FIGS. 9A, 9B, and 9C are views showing the relationship between the arrangement of the orifices of the element substrate, landed dots, and a printed image.
Figure 9B:
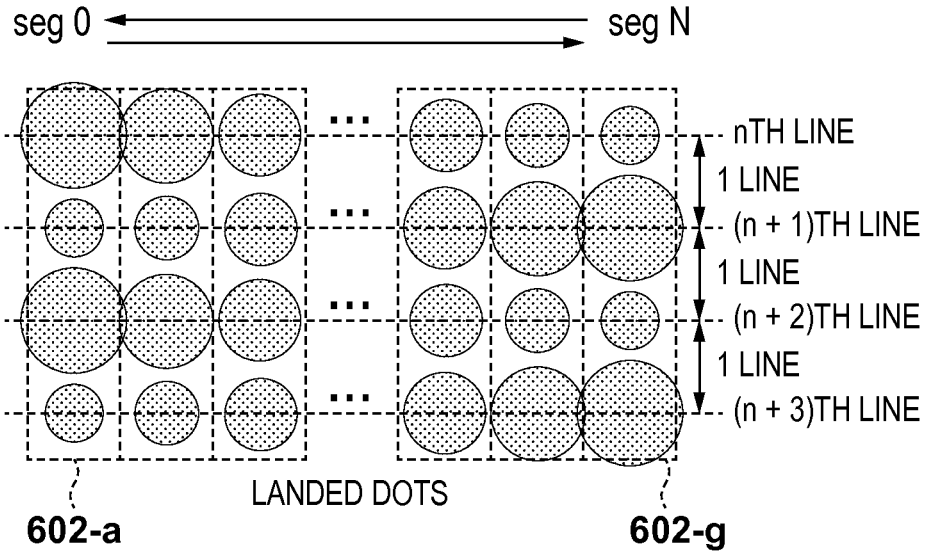
Figure 9C:
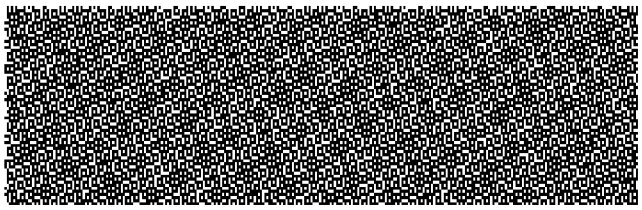

FIGS. 9A to 9C are views showing the relationship between the arrangement of the orifices of the element substrate, landed dots, and a printed image.

FIG. 9A shows the arrangement of the orifices of the element substrate. Orifices 601 are arranged in one line in a direction perpendicular to the printing medium conveyance direction. An orifice 601-*g* corresponds to the heater 302-*g*. When the heater 302-*g* is driven, the orifice 601-*g* discharges the ink. An orifice 601-*a* corresponds to the heater 302-*a*. When the heater 302-*a* is driven, the orifice 601-*a* discharges the ink.

FIG. 9B shows a state in which the discharged ink has landed on a printing medium. Each landed dot is illustrated in a size proportional to the discharge amount. A landed dot 602-*g* is formed by landing of the ink discharged from the orifice 601-*g*. A landed dot 602-*a* is formed by landing of the ink discharged from the orifice 601-*a*.

In this embodiment, the delay sequence is switched over every line time of the printing operation. For example, the delay sequence control signal CONT is set to low level when printing the nth line, and to high level when printing the next (n+1)th line. For this reason, the landed dot 602-*g* of the nth line has the smallest size. The size gradually becomes large toward the orifice 601-*a*, and the landed dot 602-*a* has the largest size. In addition, the landed dot 602-*g* of the (n+1)th line has the largest size. The size becomes small toward the orifice 601-*a*, and the landed dot 602-*a* has the smallest size. This operation is repeated every line time, as indicated in FIG. 9B as nth line, (n+1)th line, (n+2)th line, and (n+3)th line.

FIG. 9C shows an image printed using the element substrate according to the first embodiment. According to FIG. 9C, the delay sequence is switched over every line time, thereby printing an image with suppressed density unevenness.

This image is compared with a printed image when printing is performed using a conventional element substrate in which the delay sequence is not switched over every line time but fixed.

Figure 10A:
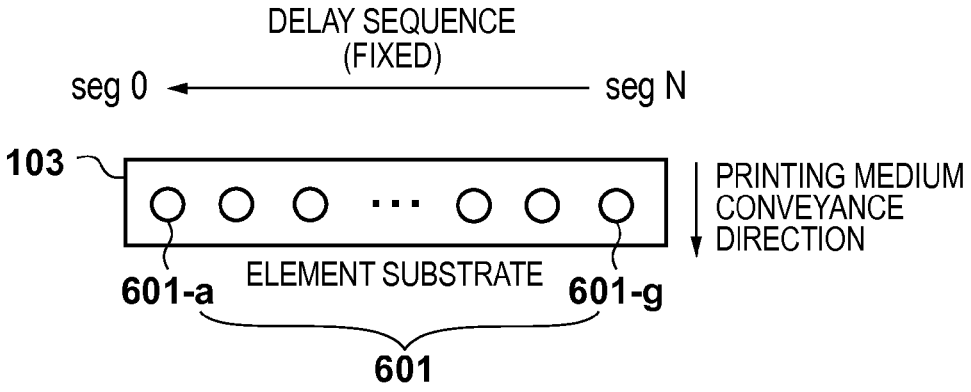
FIGS. 10A, 10B, and 10C are views showing the relationship between the arrangement of the orifices of a conventional element substrate, landed dots, and a printed image.
Figure 10B:
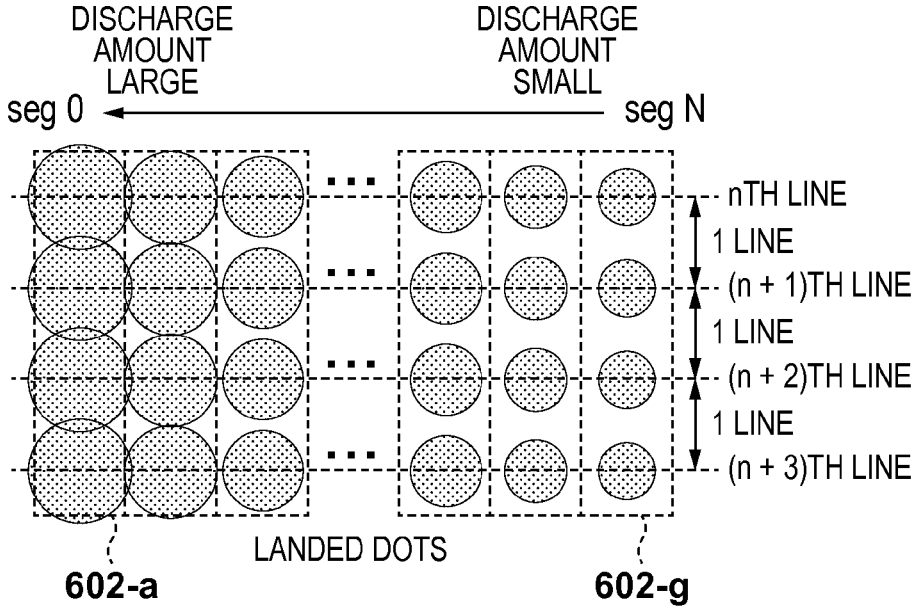
Figure 10C:
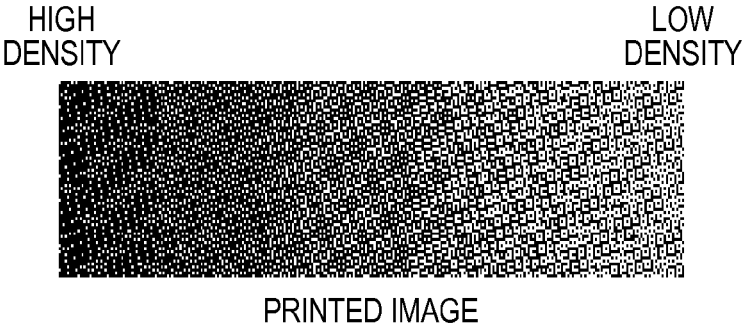

FIGS. 10A to 10C are views showing the relationship between the arrangement of the orifices of a conventional element substrate, landed dots, and a printed image. Note that FIGS. 10A to 10C correspond to FIGS. 9A to 9C. Unlike this embodiment, the delay sequence is not switched over.

As is apparent from comparison of FIGS. 10B and 9B, since the delay sequence is fixed in the conventional element substrate, the landed dot 602-*g* always has the smallest size, and the landed dot 602-*a* always has the largest size independently of the line. For this reason, the density also has a predetermined tendency and the tendency is visually recognizable. As is apparent from comparison of FIGS. 10C and 9C, density unevenness occurs in the printed image in the conventional art.

Hence, according to the above-described embodiment, control is performed to switch over the delay sequence in driving of the heaters every line time of the printing operation. The ink discharge amount difference caused by the difference between energies generated by the heaters and the landed dot size difference caused by the ink discharge amount difference are dispersed on a printing medium, thereby making the printing density unevenness hard to visually recognize. This enables high-quality image printing while suppressing density unevenness.

Note that the circuit arrangement of the delay circuit 301 is not limited to that shown in FIGS. 7A and 7B. For example, an arrangement in which the number of buffer circuits halves may be employed.

Figure 11A:
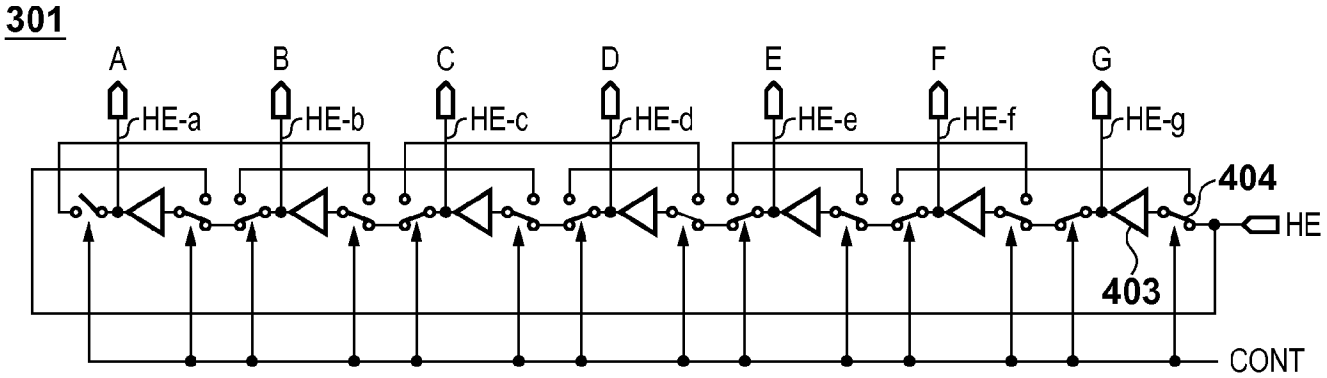
FIGS. 11A and 11B are circuit diagrams showing the arrangement of a delay circuit according to the first modification of the first embodiment of the present invention.
Figure 11B:
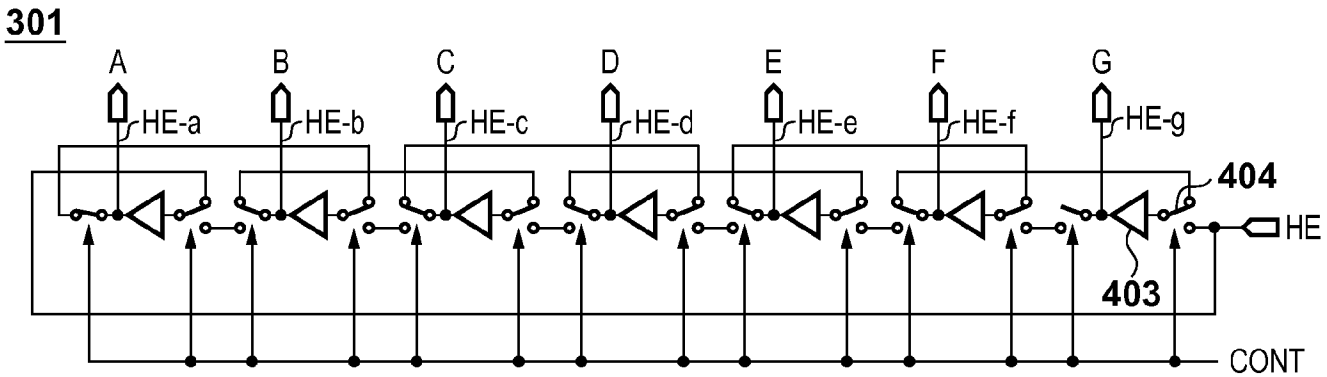

FIGS. 11A and 11B are circuit diagrams showing the arrangement of the delay circuit 301 according to the first modification of the first embodiment of the present invention.

Referring to FIGS. 11A and 11B, terminals A to G and HE correspond to the terminals A to G and HE of the delay circuit 301 shown in FIG. 6. The delay circuit 301 is formed from the buffer circuits 403 and the switchover circuits 404. The delay circuit 301 according to this modification switches over the delay sequence by switching over the connection state of the inputs and outputs of the buffer circuits. This arrangement is more advantageous than the first embodiment in terms of circuit area because the necessary number of buffer circuits can be halved as compared to the first embodiment.

FIG. 11A shows the connection state when the logic level of the delay sequence control signal CONT is low. The delay is done in the order of the signals HE-g, HE-f, HE-e, HE-d, HE-c, HE-b, and HE-a. On the other hand, FIG. 11B shows the connection state when the logic level of the delay sequence control signal CONT is high. The delay is done in the order of the signals HE-a, HE-b, HE-c, HE-d, HE-e, HE-f, and HE-g.

With the above-described arrangement, it is possible to switch over the delay sequence every line time of the printing operation and thus attain the same effect as in the first embodiment while halving the number of buffer circuits.

Figure 12A:
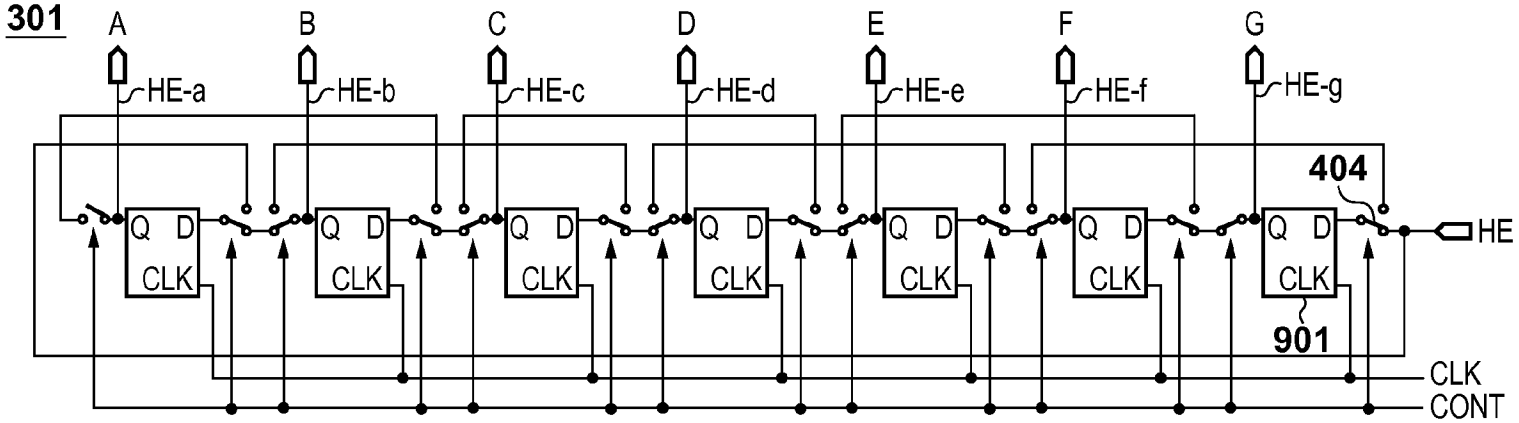
FIGS. 12A and 12B are circuit diagrams showing the arrangement of a delay circuit according to the second modification of the first embodiment of the present invention.
Figure 12B:
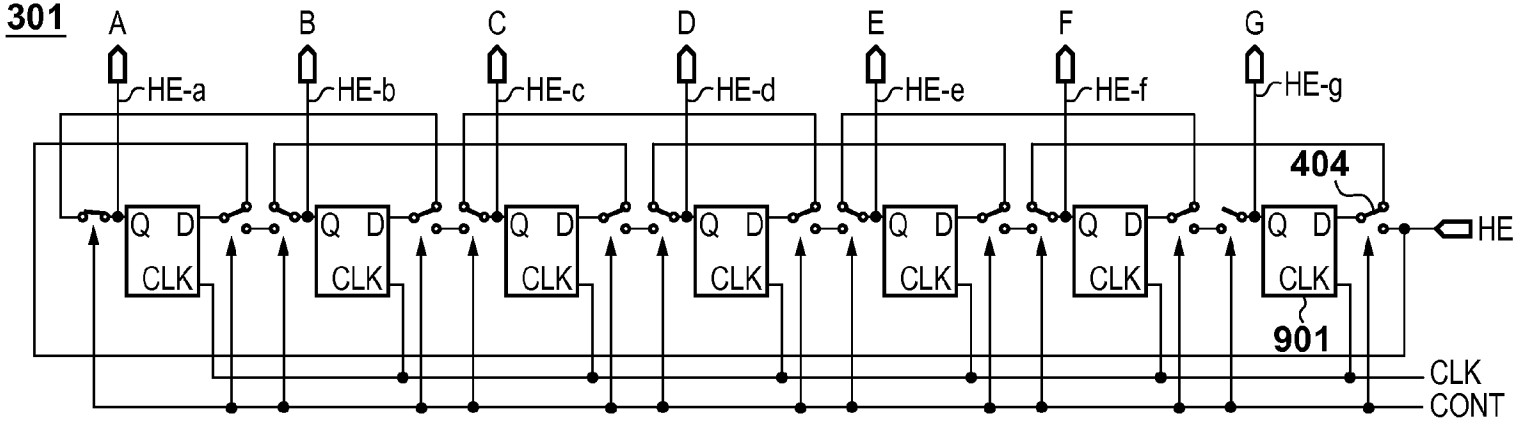

FIGS. 12A and 12B are circuit diagrams showing the arrangement of the delay circuit 301 according to the second modification of the first embodiment of the present invention. Referring to FIGS. 12A and 12B, terminals A to G and HE correspond to the terminals A to G and HE of the delay circuit 301 shown in FIG. 6. The delay circuit 301 is formed from shift registers 901 and the switchover circuits 404. The delay circuit 301 according to this modification delays a signal by a shift register formed by series-connecting a plurality of flip-flop circuits 901. This is the difference from the first embodiment and the first modification of the first embodiment. A clock signal CLK is input to the CLK terminal of the flip-flop circuit of each stage. The signal HE is transferred to the flip-flop circuit of the next stage for each pulse of the clock signal.

FIG. 12A shows the connection state when the logic level of the delay sequence control signal CONT is low. The delay is done in the order of the signals HE-g, HE-f, HE-e, HE-d, HE-c, HE-b, and HE-a. On the other hand, FIG. 12B shows the connection state when the logic level of the delay sequence control signal CONT is high. The delay is done in the order of the signals HE-a, HE-b, HE-c, HE-d, HE-e, HE-f, and HE-g. With the above-described arrangement, the delay sequence is switched over every line time of the printing operation, as in the first embodiment.

Figure 13B:
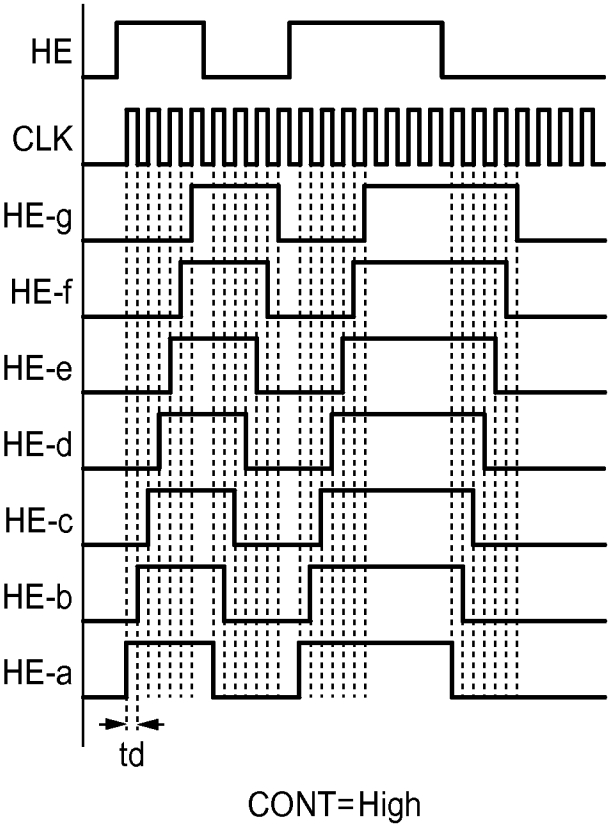
FIGS. 13A and 13B are timing charts showing the operation of the delay circuit according to the second modification of the first embodiment of the present invention.
Figure 13A:
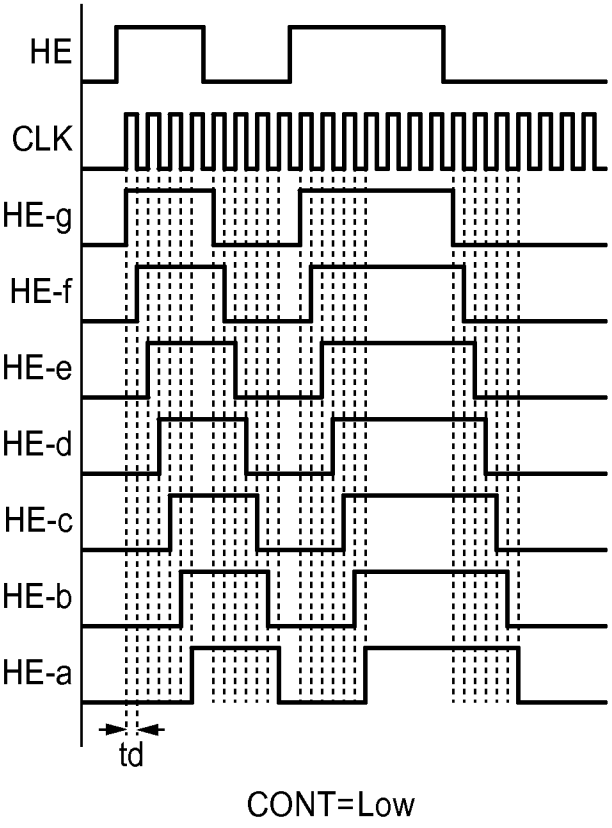

FIGS. 13A and 13B are timing charts showing the operation of the delay circuit according to the second modification of the first embodiment of the present invention.

A basic delay amount td of the signal HE is determined by the frequency of the clock signal CLK. It is therefore possible to adjust the basic delay amount td by changing the frequency of the clock signal CLK.

FIG. 13A shows the timing chart of the operation when the logic level of the delay sequence control signal CONT is low, and FIG. 13B shows the timing chart of the operation when the logic level of the delay sequence control signal CONT is high.

This arrangement is more advantageous than the first embodiment and the first modification of the first embodiment not only because the same effect as in the first embodiment can be attained but also because the basic delay amount td of the signal HE can freely be adjusted.

Second Embodiment

Figures 14A, 14B:
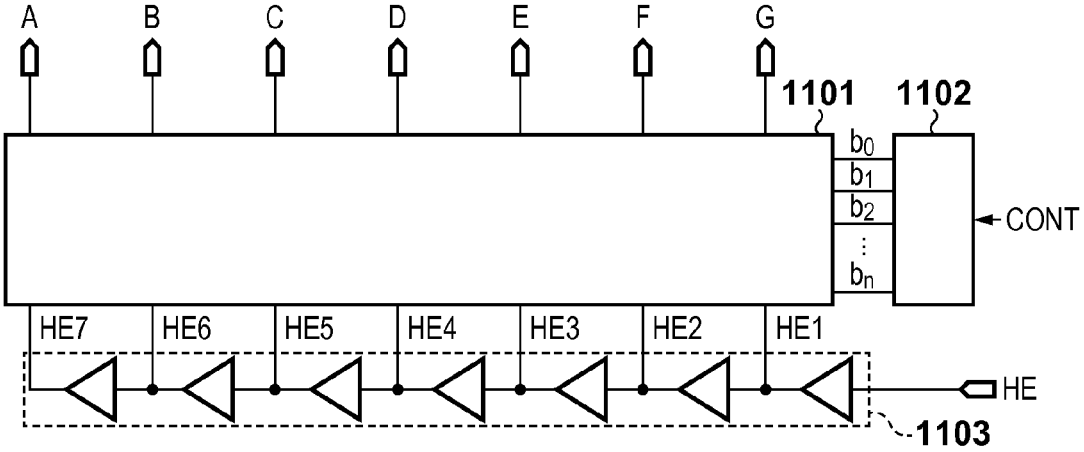
FIGS. 14A and 14B are circuit diagrams showing the arrangement of a delay circuit according to the second embodiment of the present invention and a view for explaining signals to be handled by the circuit, respectively.

FIGS. 14A and 14B are circuit diagrams showing the arrangement of a delay circuit 301 according to the second embodiment of the present invention and a view for explaining signals to be handled by the circuit, respectively.

FIG. 14A shows the circuit arrangement of the delay circuit 301 according to the second embodiment of the present invention. Terminals A to G and HE correspond to the terminals A to G and HE of the delay circuit 301 shown in FIG. 6. The delay circuit 301 according to this embodiment is formed from a decoder circuit 1101, a random number generation circuit 1102, and a delay buffer group 1103. In the delay circuit 301 according to this embodiment, the delay sequence is random. This is the difference from the above-described first embodiment. Hence, although two kinds of delay sequences are possible in the first embodiment, more delay sequences can be generated in the second embodiment.

The delay buffer group 1103 generates signals by delaying a signal HE, that is, delayed heat enable signals HE1 to HE7. In this case, the signal HE7 is the most delayed signal, and the signal HE1 is the least delayed signal. The decoder circuit 1101 selectively outputs one of the delayed heat enable signals HE1 to HE7 to one of the terminals A to G in accordance with n+1 (n is an integer) random bits $b_0$ to $b_n$.

FIG. 14B is the truth table of the decoder circuit 1101. For example, when the random number (Code) is 4, the signal HE2 is output to the terminal G, the signal HE1 is output to the terminal F, the signal HE4 is output to the terminal E, the signal HE3 is output to the terminal D, the signal HE7 is output to the terminal C, the signal HE5 is output to the terminal B, and the signal HE6 is output to the terminal A. When a delay sequence control signal CONT is inverted, the random number generation circuit 1102 generates new random numbers $b_0$ to $b_n$ and outputs them to the decoder circuit 1101. The delay sequence control signal CONT is inverted every line time, and the random number generation circuit 1102 generates new random numbers every line time. With this operation, one of the signals HE1 to HE7 is output to one of the terminals A to G at random. That is, a random delay sequence is generated.

Figure 15A:
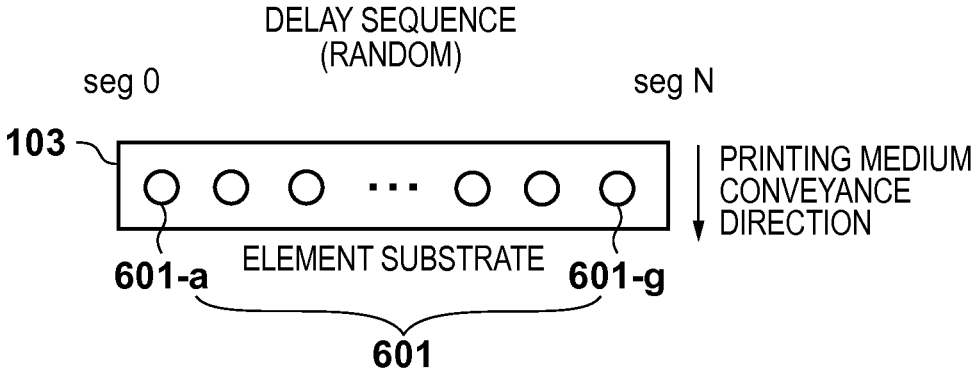
FIGS. 15A, 15B, and 15C are views showing the relationship between the arrangement of the orifices of an element substrate, landed dots, and a printed image according to the second embodiment of the present invention.
Figure 15B:
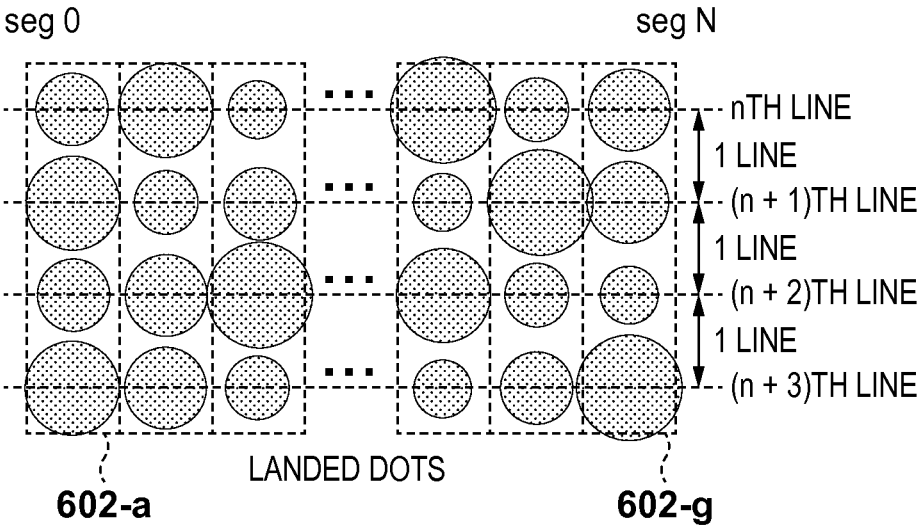
Figure 15C:
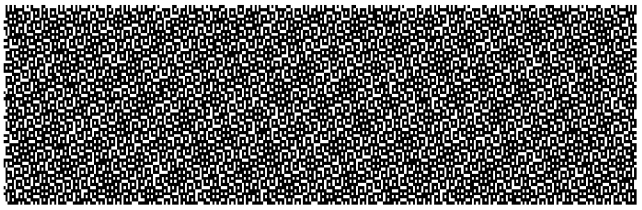

FIGS. 15A to 15C are views showing the relationship between the arrangement of the orifices of an element substrate, landed dots, and a printed image according to the second embodiment. Note that FIGS. 15A to 15C correspond to FIGS. 9A to 9C. Unlike the first embodiment, the delay sequence is random.

As is apparent from comparison of FIGS. 15B and 9B, the sizes of landed dots 602-*a* and 602-*g* of interest change at random in this embodiment, although the delay sequence is inverted every line time in the element substrate of the first embodiment. As a result, since the delay sequence is switched over at random every line time, landed dots having different sizes are distributed at random even on the printed image, and the density unevenness is hard to visually recognize, as shown in FIG. 15C.

According to the above-described embodiment, control is performed to switch over the delay sequence in driving of the heaters at random every line time of the printing operation. The ink discharge amount difference caused by the difference between energies generated by the heaters and the landed dot size difference caused by the ink discharge amount difference are dispersed on a printing medium, thereby making the printing density unevenness hard to visually recognize. This enables high-quality image printing while suppressing density unevenness.

Third Embodiment

Figure 16:
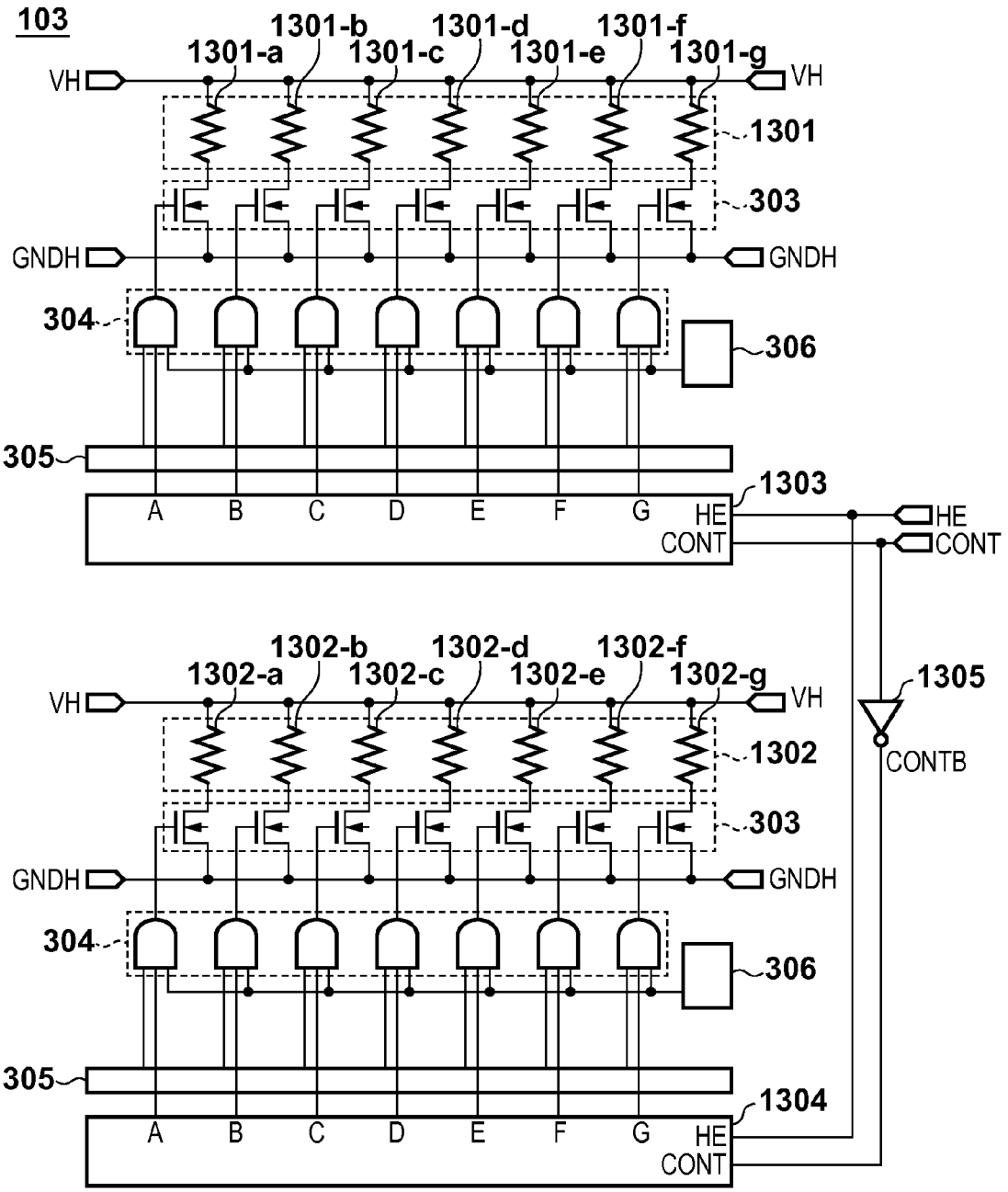
FIG. 16 is a circuit diagram showing part of an element substrate according to the third embodiment of the present invention, particularly, heaters serving as printing elements and a driving circuit thereof.

FIG. 16 is a circuit diagram showing part of an element substrate 103 according to the third embodiment of the present invention, particularly, heaters serving as printing elements and a driving circuit thereof. As is apparent from comparison of FIGS. 16 and 6, in the third embodiment, two element substrates each having the arrangement shown in FIG. 6 are provided to form two arrays of heater groups, and the arrays have different delay sequences. This is the difference from the first and second embodiments. Note that the arrangement shown in FIG. 16 may further be extended to attain an arrangement including a plurality of heater group arrays of three or more arrays, that is, at least two arrays of heater groups.

Referring back to FIG. 16, the element substrate 103 is provided with a heater group 1301 of the first array (printing element array) and a heater group 1302 of the second array (printing element array). In addition, a first delay circuit 1303 that generates delayed enable signals for the heater group 1301 of the first array, and a second delay circuit 1304 that generates delayed enable signals for the heater group 1302 of the second array are provided. An inverted signal CONTB of a delay sequence control signal CONT inverted by an inverter 1305 is input to the second delay circuit 1304. With this arrangement, control is performed to change the delay sequence between the arrays.

Note that in FIG. 16, the heater group 1301 of the first array includes heaters 1301-*a* to 1301-*g*, and the heater group 1302 of the second array includes heaters 1302-*a* to 1302-*g*, which are the same as the heaters described with reference to FIG. 6. The arrangement of the first delay circuit 1303 and the second delay circuit 1304 is the same as described with reference to FIGS. 7A and 7B. Since the remaining components are the same as those used in FIG. 6, the same reference numerals and symbols denote the same components, and a description thereof will be omitted.

Figure 17A:
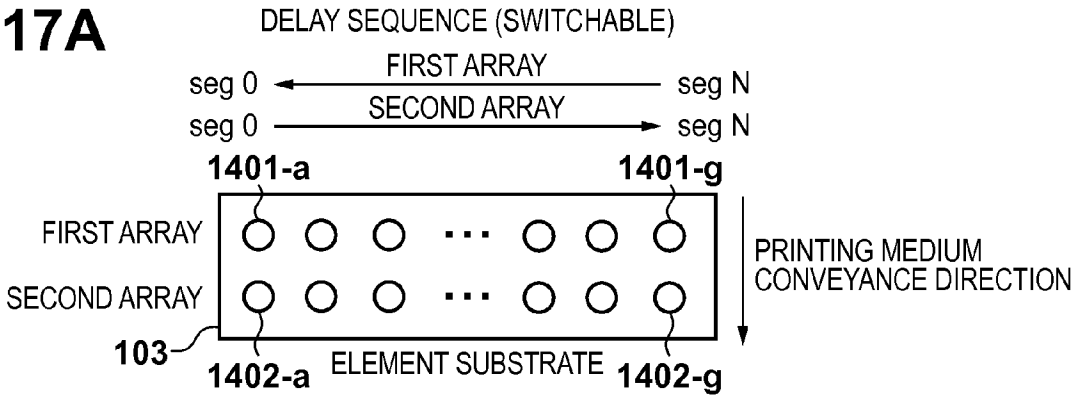
FIGS. 17A, 17B, and 17C are views showing the relationship between the arrangement of the orifices of an element substrate, landed dots, and a printed image according to the third embodiment of the present invention.
Figure 17B:
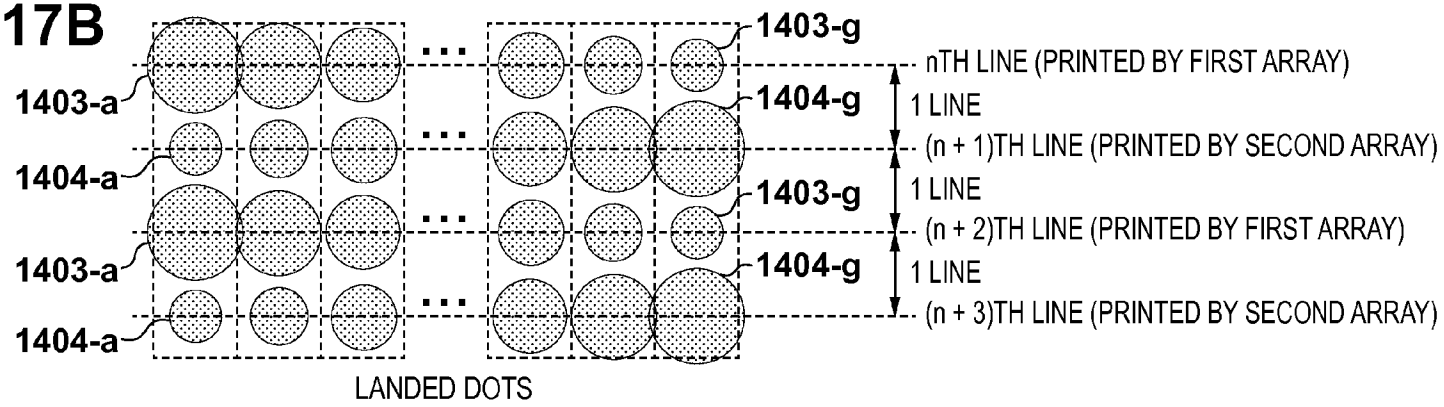
Figure 17C:
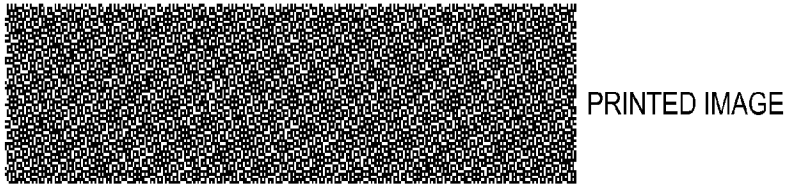

FIGS. 17A to 17C are views showing the relationship between the arrangement of the orifices of the element substrate, landed dots, and a printed image according to the third embodiment. Note that FIGS. 17A to 17C correspond to FIGS. 9A to 9C. Unlike the first embodiment, two arrays of heaters are formed. Note that reference numerals 1401-*a*, 1402-*a*, 1401-*g*, and 1402-*g* in FIG. 17A denote orifices.

As is apparent from comparison of FIGS. 17B and 9B, the heaters of the first array are driven in the nth line, and the heaters of the second array are driven in the (n+1)th line, in this embodiment, although the delay sequence is inverted every line time in the element substrate of the first embodiment. In addition, the heaters of the first array are driven again in the (n+2)th line, and the heaters of the second array are driven again in the (n+3)th line. Note that reference numerals 1403-*a*, 1404-*a*, 1403-*g*, and 1404-*g* in FIG. 17B denote landed dots.

As a result, since the delay sequence is switched over every line time in the first array and the second array, landed dots having different sizes are distributed even on the printed image, and the density unevenness is hard to visually recognize, as shown in FIG. 17C. This implements high-quality image printing while suppressing density unevenness in the third embodiment as well.

Note that in the above-described first to third embodiments, the delay sequence is switched over every line time. However, the present invention is not limited to this, and the delay sequence may be switched over every two line times or four line times, or every n latch times.

In the above-described first to third embodiments, the delay circuit and the heaters serving as printing elements are integrated on the same element substrate. However, the present invention is not limited to this. For example, the printing elements may be integrated on the first substrate, the delay circuit may be integrated on the second substrate, and these substrates may be integrated to form a printhead. When the print width is long, as in, for example, a full-line printhead, a plurality of first substrates may be integrated, and one or a plurality of second substrates may be integrated. On the other hand, for a printing apparatus that performs printing by reciprocally moving the printhead, the printhead may be formed by integrating one first substrate and one second substrate or using an element substrate on which the delay circuit and the printing elements are integrated.

The above-described element substrate is used in an inkjet full-line printhead, and heaters are used on the element substrate as printing elements. However, the present invention is not limited to this. For example, the present invention is also applicable to a so-called serial printhead that scans and prints a printing medium with a print width smaller than the width of the printing medium using one or a plurality of printing element substrates of the present invention. As the printing element, a laser or a diode may be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-176078, filed Aug. 27, 2013, which are hereby incorporated by reference herein in its entirety.

What is claimed is:

1. An element substrate comprising:

a plurality of printing elements configured to generate energy to be used to discharge liquid;

a wiring configured to supply a driving power to be used to drive said plurality of printing elements;

a first delay buffer group formed by series-connecting a plurality of buffer circuits in which a heat enable signal is transferred while being delayed by said plurality of buffer circuits;

a second delay buffer group formed by series-connecting a plurality of buffer circuits in which the heat enable signal is transferred while being delayed by said plurality of buffer circuits in a direction different from an arrayed direction of said plurality of buffer circuits of said first delay buffer group; and a switchover circuit configured to switch over, in accordance with a control signal, a delay sequence in a case where supplying the heat enable signal to each of said plurality of printing elements by switching over between said first delay buffer group and said second delay buffer group.

2. The element substrate according to claim 1, wherein a logic level of the control signal is inverted every time the predetermined time elapses, and said switchover circuit switches over the delay sequence every predetermined time based on the control signal.

3. The element substrate according to claim 2, wherein the predetermined time is a time necessary for a printing element array formed by said plurality of printing elements to print one line.

4. The element substrate according to claim 1, wherein the element substrate comprises:

at least two printing element arrays each formed from said plurality of printing elements, and a plurality of delay circuits and a plurality of switchover circuits in correspondence with said at least two printing element arrays.

5. The element substrate according to claim 4, further comprising an inverter circuit configured to invert a logic level of the control signal.

6. The element substrate according to claim 5, wherein the control signal changes, for each of said plurality of printing element arrays, the delay sequence of the printing elements included in the printing element array.

7. A printhead that uses an element substrate, wherein said element substrate comprises:

a plurality of printing elements configured to generate energy to be used to discharge liquid;

a wiring configured to supply a driving power to be used to drive said plurality of printing elements;

a first delay buffer group formed by series-connecting a plurality of buffer circuits in which a heat enable signal is transferred while being delayed by said plurality of buffer circuits;

a second delay buffer group formed by series-connecting a plurality of buffer circuits in which the heat enable signal is transferred while being delayed by said plurality of buffer circuits in a direction different from an arrayed direction of said plurality of buffer circuits of said first delay buffer group; and a switchover circuit configured to switch over, in accordance with a control signal, a delay sequence in a case where supplying the heat enable signal to each of said plurality of printing elements by switching over between said first delay buffer group and said second delay buffer group, and wherein said printhead performs printing by a plurality of printing elements by supplying the driving power and the heat enable signal to said plurality of printing elements.

8. The printhead according to claim 7, wherein the printhead comprises a full-line printhead having a print width corresponding to a width of a printing medium.

9. The printhead according to claim 8, wherein said full-line printhead comprises an inkjet printhead configured to print an image by discharging ink to the printing medium.

10. A printhead comprising:

a first element substrate, wherein a plurality of printing elements configured to generate energy to be used to discharge liquid, and a wiring configured to supply a driving power to be used to drive said plurality of printing elements are integrated on said first element substrate; and a second element substrate, wherein a first delay buffer group formed by series-connecting a plurality of buffer circuits in which a heat enable signal is transferred while being delayed by said plurality of buffer circuits, a second delay buffer group formed by series-connecting a plurality of buffer circuits in which the heat enable signal is transferred while being delayed by said plurality of buffer circuits in a direction different from an arrayed direction of said plurality of buffer circuits of said first delay buffer group, and a switchover circuit configured to switch over, in accordance with a control signal, a delay sequence in a case where supplying the heat enable signal to each of said plurality of printing elements by switching over between said first delay buffer group and said second delay buffer group are integrated on said second element substrate.

11. The printhead according to claim 10, wherein a plurality of said first element substrates are integrated, and a plurality of said second element substrates are integrated.

12. The printhead according to claim 10, wherein said one first element substrate and said one second element substrate are integrated.

13. A printing apparatus that performs printing using an inkjet printhead configured to print an image by discharging ink to a printing medium, wherein said inkjet printhead is a full-line printhead having a print width corresponding to a width of the printing medium, and wherein said full-line printhead uses an element substrate comprising:

a plurality of printing elements configured to generate energy to be used to discharge liquid;

a wiring configured to supply a driving power to be used to drive said plurality of printing elements;

a first delay buffer group formed by series-connecting a plurality of buffer circuits in which a heat enable signal is transferred while being delayed by said plurality of buffer circuits;

a second delay buffer group formed by series-connecting a plurality of buffer circuits in which the heat enable signal is transferred while being delayed by said plurality of buffer circuits in a direction different from an arrayed direction of said plurality of buffer circuits of said first delay buffer group; and a switchover circuit configured to switch over, in accordance with a control signal, a delay sequence in a case where supplying the heat enable signal to each of said plurality of printing elements by switching over between said first delay buffer group and said second delay buffer group, and wherein said full-line printhead performs printing by a plurality of printing elements by supplying the driving power and the heat enable signal to said plurality of printing elements.

14. The apparatus according to claim 13, wherein the control signal is supplied for each printing operation of one line of the inkjet printhead.

* * * * *